US010919129B2

(12) United States Patent
Omry et al.

(10) Patent No.: US 10,919,129 B2
(45) Date of Patent: Feb. 16, 2021

(54) VISE TABLE

(71) Applicant: The Stanley Works Israel Ltd., Rosh Ha'Ayin (IL)

(72) Inventors: Adar Omry, Hertzeliya (IL); Shalom Saigauvker, Rosh Ha'ayin (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 412 days.

(21) Appl. No.: 16/026,178

(22) Filed: Jul. 3, 2018

(65) Prior Publication Data

US 2020/0009706 A1 Jan. 9, 2020

(51) Int. Cl.

| | |
|---|---|
| ***B25B 1/02*** | (2006.01) |
| ***B25B 1/12*** | (2006.01) |
| ***B25H 1/04*** | (2006.01) |

(52) U.S. Cl.

CPC ..... *B25B 1/12* (2013.01); *B25B 1/02* (2013.01); *B25H 1/04* (2013.01)

(58) Field of Classification Search

CPC .... B25B 1/00; B25B 1/02; B25B 1/04; B25B 5/02; B25B 5/04; B25B 11/00

See application file for complete search history.

(56) References Cited

U.S. PATENT DOCUMENTS

| | | | | |
|---|---|---|---|---|
| 3,861,432 A | | 1/1975 | Rothenberger | |
| 4,181,296 A | | 1/1980 | Bassett | |
| 4,412,676 A | | 11/1983 | Jackson | |
| 4,509,731 A | | 4/1985 | Schaal | |
| D279,736 S | * | 7/1985 | Zastera | D6/684 |
| 4,569,510 A | | 2/1986 | Haramoto | |
| 4,593,892 A | | 6/1986 | Terstegge | |
| 4,880,221 A | | 11/1989 | Richards | |
| 4,899,999 A | | 2/1990 | Arnold | |
| 5,067,535 A | * | 11/1991 | Wolff | B25H 1/04 144/286.1 |
| D351,295 S | * | 10/1994 | Noniewicz | D6/684 |
| 5,417,409 A | | 5/1995 | Reddell | |
| 5,862,842 A | | 1/1999 | You | |
| 6,334,609 B1 | | 1/2002 | Chun | |
| 9,278,446 B2 | | 3/2016 | Lifshitz | |
| 2020/0009706 A1 | * | 1/2020 | Omry | B25H 1/08 |

FOREIGN PATENT DOCUMENTS

| | | |
|---|---|---|
| DE | 102006024291 A1 | 11/2007 |
| EP | 1452274 | 5/2006 |
| FR | 2373714 A1 | 7/1978 |

OTHER PUBLICATIONS

GB Search Report excerpt dated, Dec. 31, 2019 in corresponding application No. 1909523.1.

* cited by examiner

*Primary Examiner* — Lee D Wilson
(74) *Attorney, Agent, or Firm* — Bruce S. Shapiro

(57) ABSTRACT

The present invention relates to an integrated vise and work table. The disclosed vise table allows an operator to clamp an object in place so that the same can worked on in a hands-free method. The vise table includes a table block, a vise head block, a threaded guide, a rotator, and an activation mechanism that allows the operator to selectively vise in a threaded mode or in an unthreaded mode. In the threaded mode, the vise head block may only be moved by rotating a threaded guide. In the unthreaded mode, the vise head block may only be moved by applying force to the vise head block in the desired direction of movement.

10 Claims, 4 Drawing Sheets

VISE TABLE

FIELD OF THE INVENTION

The present invention relates to a vise table. More specifically the invention relates to a vise table having a mechanism wherein an operator can selectively move the vise head block in a threaded mode or an unthreaded mode.

BACKGROUND OF THE INVENTION

The general concept of a vise is well known. Typically, they are configured to secure an object in place and allow an operator to work on said object in a hands-free manner.

Vises typically include a fixed jaw and a movable jaw. The moveable jaw is often connected to the fixed jaw by a threaded mechanism or screw. By applying rotational force to the threaded mechanism, an operator can move position the movable jaw such that it holds an object between the movable and fixed jaw. The application of rotational force to the threaded mechanism is often a time-consuming task because the threaded mechanism often has a very small diameter in comparison to the distance that the movable jaw has to traverse. It would be advantageous to have a vise that allow the movable jaw to selectively be moved in a threaded mode or an unthreaded mode. In said threaded mode, movement of the movable jaw can only occur by applying rotational force to the threaded mechanism. In said unthreaded mode, movement of the movable jaw can be achieved by applying force directly to the movable jaw in the desired direction of movement.

In addition to the foregoing, it would be advantageous to have a portable work table with an integrated vise that overcomes one or more of the foregoing shortcomings.

SUMMARY OF THE INVENTION

According to an aspect of this disclosure, a vise table having a table block including an upper work surface. The vise table also includes a vise head block operably connected to the table block via a threaded guide, and wherein said vise head block is configured to move between an open position and a closed position. In the open position, the vise head block is distal from the table block. In the closed position, the vise head block is adjacent to the table block. The vise table also includes a rotator configured to selectively rotate the threaded guide in either a first direction or a second direction. Rotating the threaded guide in the first direction moves the vise head block toward the open position. Rotating the threaded guide in the second direction moves the vise head block toward the closed position. The vise table further includes an activation mechanism configured to selectively facilitate movement of the vise head block in either a threaded mode or an unthreaded mode. In the threaded mode, movement of the vice head block can only be achieved by rotating the threaded guide. In the unthreaded mode, movement of the vise head block can only be achieved by applying force to the vise head block in the desired direction of movement. The activation mechanism includes an activator that is movable between an unactivated position and an activated position. The activation mechanism also includes a trigger tooth in communication with the activator and movable between a first position and second position. When the activator is in the unactivated position, the trigger tooth is in the first position. When the activator is in the activated position, the trigger tooth is in the second position. The activation mechanism also includes an engagement block having a threaded portion configured to correspond to the threaded guide, and wherein said engagement block is in communication with the trigger tooth and movable between a disengaged position and an engaged position. When the trigger tooth is the first position, the engagement block is in the disengaged position, wherein the threaded portion is disengaged from the threaded guide. This corresponds to the unthreaded mode. When the trigger tooth is in the second position, the engagement block is in the engaged position, wherein the threaded portion is engaged to the threaded guide. This corresponds to the threaded mode.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Features of the vise table in accordance with one or more embodiments are shown in the drawings, in which like reference numerals designate like elements. The drawings form part of this original disclosure in which.

DETAILED DESCRIPTION OF THE ILLUSTRATED EMBODIMENT(S)

Figure 1:
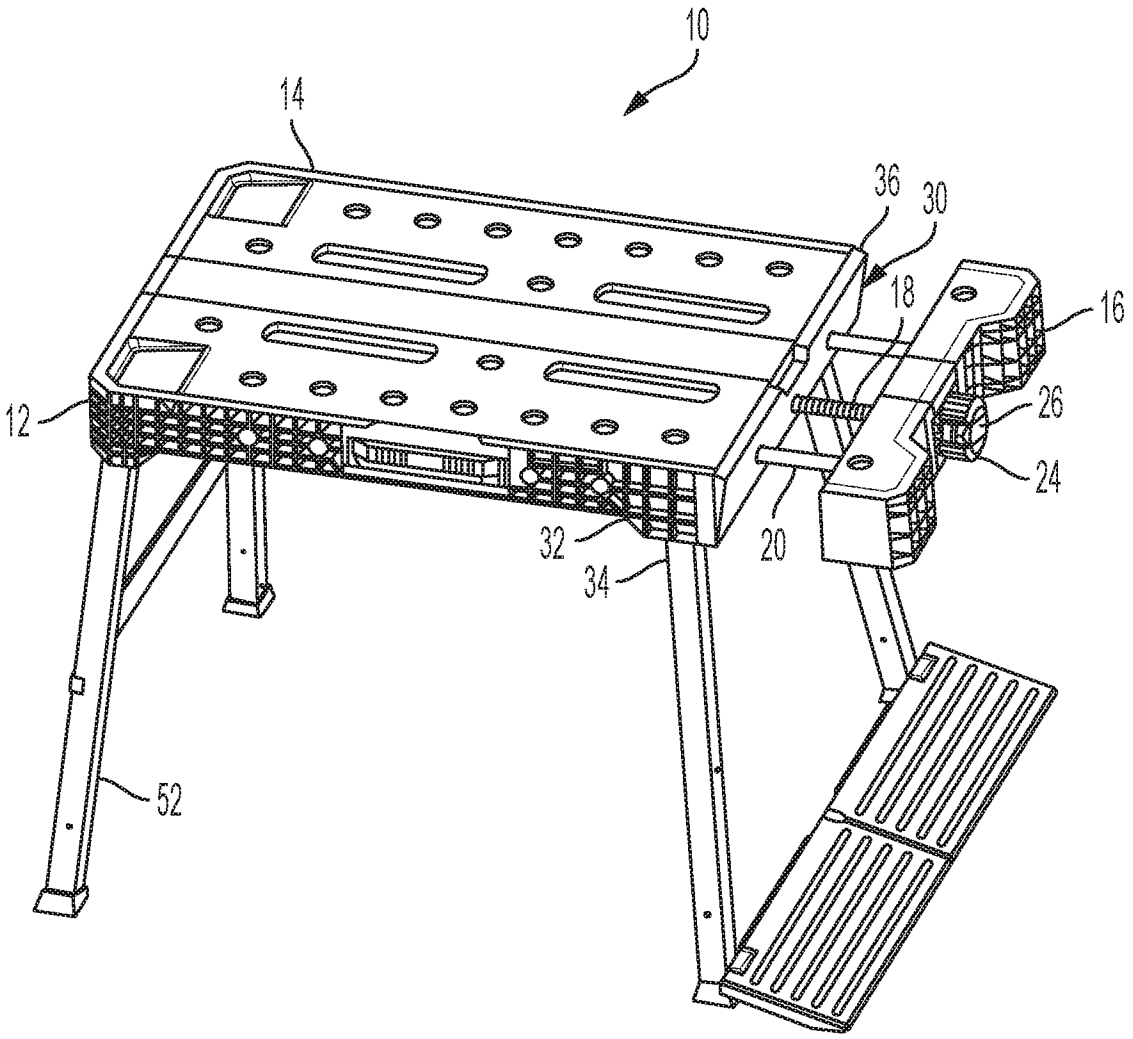
FIG. 1 illustrates a perspective view of the vise table according the present disclosure with the vise head block in the open position.

FIG. 1 illustrates a perspective view of a vise table 10. The vise table 10 includes a table block 12. The table block 12 has an upper working surface 14. The vise table 10 also includes a vise head block 16 coupled to the table block 12 via a threaded guide 18. In addition to the threaded guide 18, the vise head block 16 may also be coupled to the table block 12 via one or more guides 20. Vise head block 16 is configured to be movable between an open position and a closed position. Guide 20 may be configured to stabilize the movement of the vise head block 16 as it moved between the open position and the closed position. In the open position, the vise head block 16 is distal from the table block 12. In the closed position, the vise head block 16 is adjacent to the table block 12. Those skilled in the art will recognize that the vise table 10 is configured to hold an object 22, such as a piece of wood, between the vise head block 16 and the table block 12. (See FIGS. 2 and 3.) As such, it will be recognized that the closed position can be achieved when either the vise head block 16 is adjacent the table block 12 or when an object 22 that is being held by the vise head block 16 is adjacent the table block 12.

The threaded guide 18 may be coupled to a rotator 24. Rotator 24 is configured to selective rotate the threaded guide 18 in a first direction or in a second direction. Rotating the threaded guide in the first direction may move the vice head block 16 toward the closed position and rotating the threaded guide in the second direction may move the vice head block 16 toward the open position. Those skilled in the art will recognize that rotator 24 could be a knob, a crank, a handle, a wheel, or any other known device configured to impart rotational force. As disclosed in the figures, rotator 24 is a circular knob with an integrated foldable handle 26. Foldable handle 26 may be deployed to give the rotator 24 a larger radius and thereby allow an operator to impart faster, more efficient rotational force to the threaded guide 18.

Figure 2:
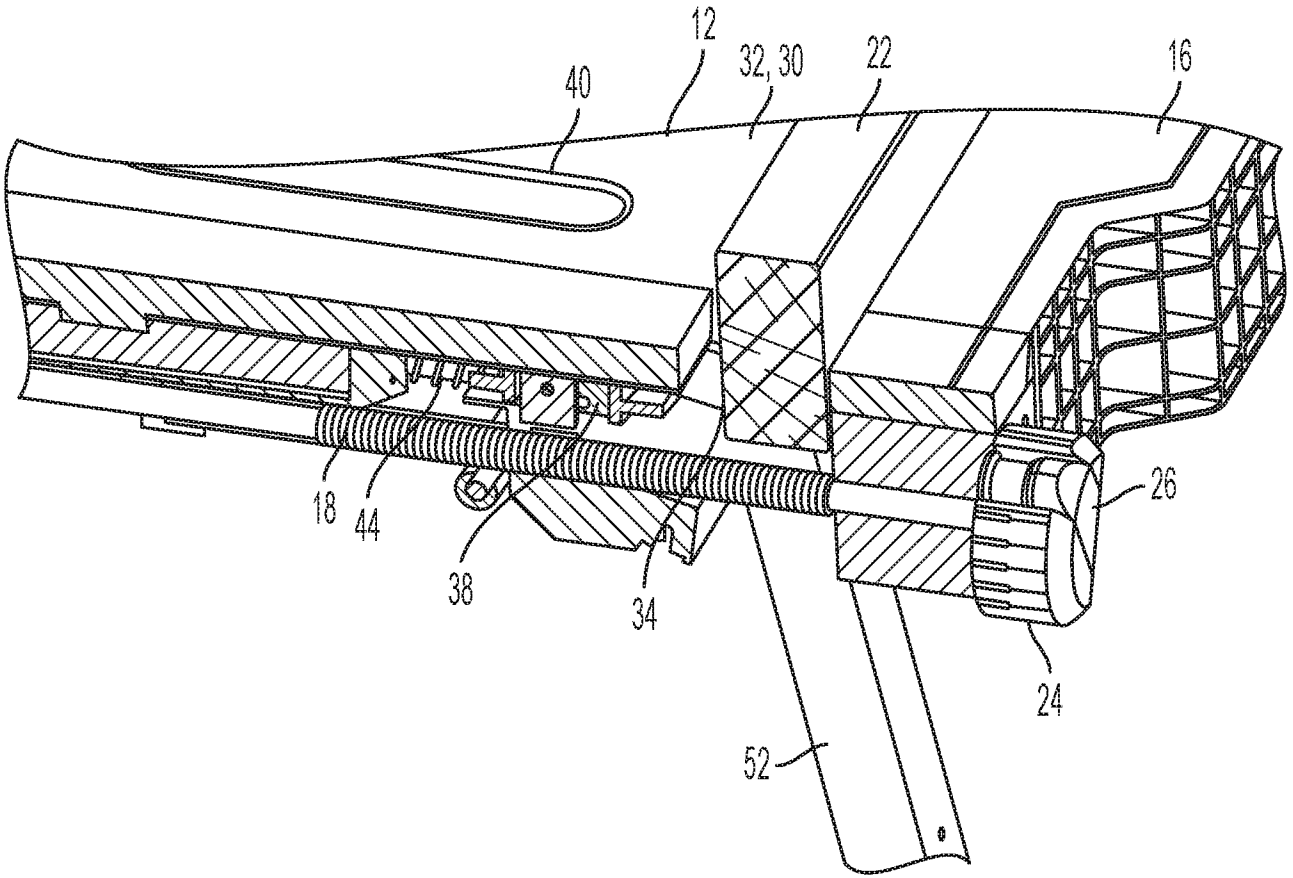
FIG. 2 illustrates cross sectional view of the vise table showing the unthreaded mode.
Figure 3:
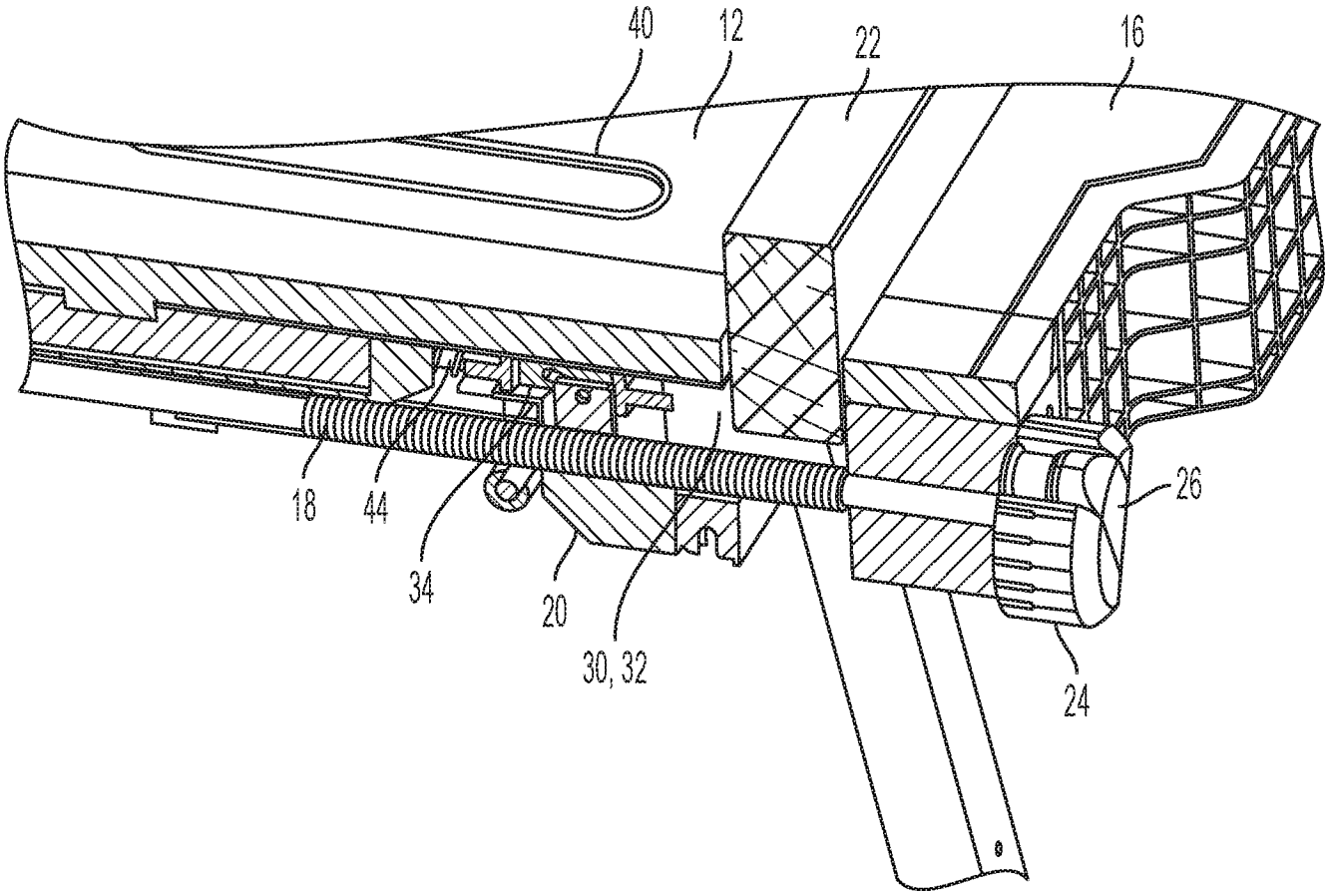
FIG. 3 illustrates a cross sectional view of the vise table showing the threaded mode.
Figure 4:
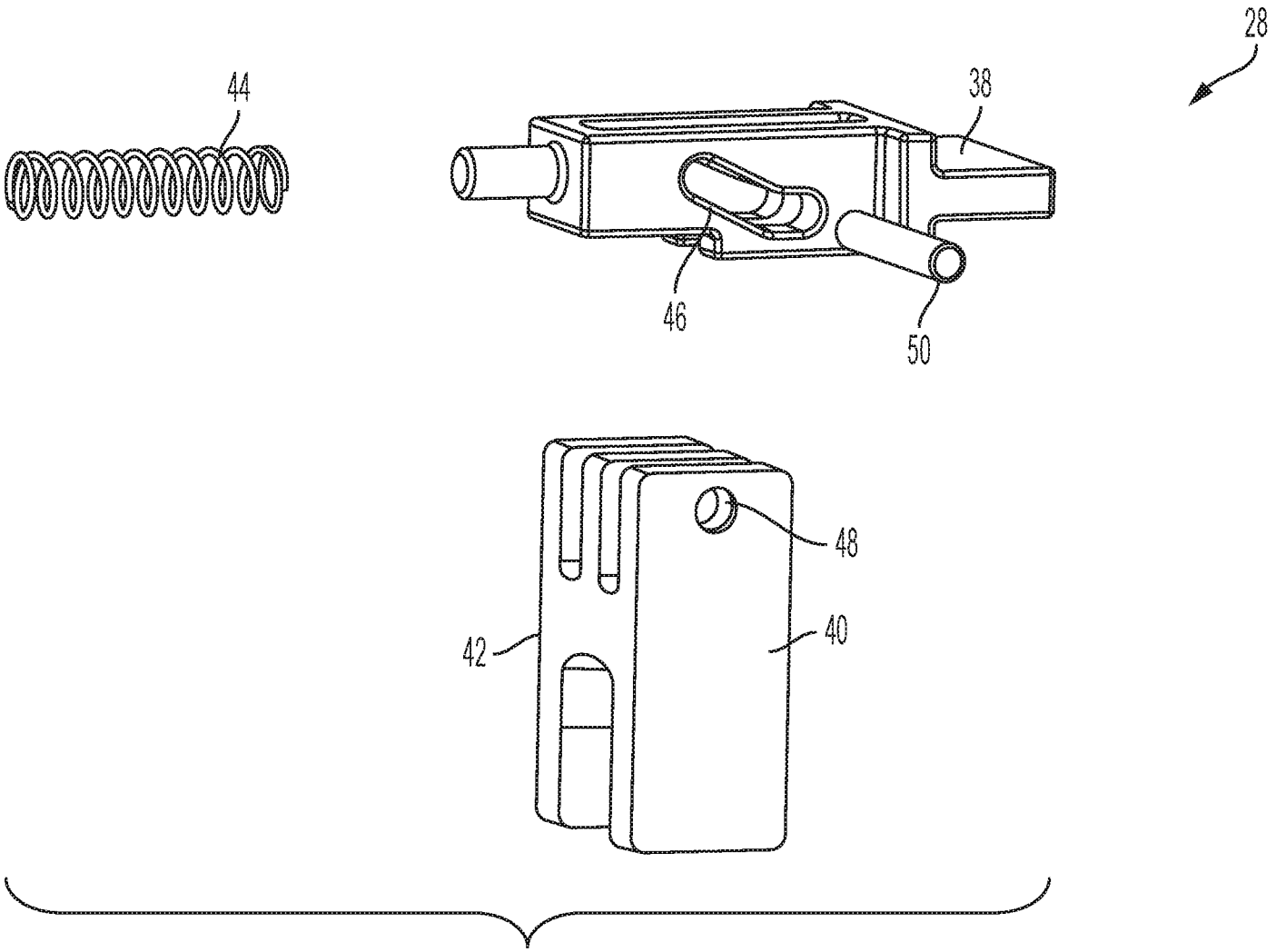
FIG. 4 illustrates a detailed view of some of the smaller components of the activation mechanism.

As shown in FIGS. 2, 3 and 4, the vise table 10 also includes an activation mechanism 28. Activation mechanism 28 is configured to selectively facilitate movement of the vise head block 22 in either a threaded mode or in an unthreaded mode. In the threaded mode, movement of the vise head block 16 can only be achieved by rotating the threaded guide 18. In the unthreaded mode, movement of the vice head block 16 can only be achieved by applying force to the vise head block 16 in the desired direction of movement.

The activation mechanism 28 includes an activator 30 that is accessible from outside the table block 12. Activator 30 is movable between an unactivated position and an activated position. In one embodiment, the activator 30 may be a flap 32 connected to the table block 12 via hinge 34. As shown in FIG. 2, flap 32 is in the unactivated position, when an edge 36 is hinged away from table block 12. Conversely, when edge 36 is adjacent the table block 12, the flap 32 is in the activated position. Those skilled in the art will recognize that the activator 30 could also be a button, switch, slide or piston that is accessible from the outside of table block 12 and movable between an unactivated position and an activated position.

The activation mechanism 28 also includes a trigger tooth 38. The trigger tooth 38 is configured to be in communication with the activator 30 and moveable between a first position and a second position. The movement of the activator 30 controls the movement of the trigger tooth 38. As shown in FIG. 2, when the activator 30 is in the unactivated position, the trigger tooth 38 is in its first position. FIG. 3 shows activator 30 in the activated position. Correspondingly, when the trigger tooth 38 is in its second position.

The activation mechanism 28 also includes an engagement block 40. Engagement block 40 includes a threaded portion 42. The engagement block 40 is in communication with the trigger tooth 38 and configured to move between a disengaged position and an engaged position. The threaded portion 42 is configured to correspond to the threaded guide 18. As such, when the threaded portion 42 and the threaded guide 18 are engaged to one another, movement of the vise head block 16 can be achieved by rotating the threaded guide 18. When the trigger tooth 38 is in its first position, the engagement block 40 is moved to its disengaged position, wherein the threaded portion 42 is disengaged from the threaded guide 18. When the engagement block 40 is in the disengaged position, the movement of the vise head block 16 is in the unthreaded mode. Conversely, when the trigger tooth 38 is in its second position, the engagement block 40 is moved to its engaged position, wherein the threaded portion 42 is engaged to the threaded guide 18. When the engagement block 40 is in the engaged position, the movement of the vise head block is in the threaded mode.

In certain embodiments, the activation mechanism 28 may also include a spring 44. Spring 44 may be disposed between the table block 12 and the trigger tooth 38. Spring 44 may be configured to bias the trigger tooth 38 toward its first position, which correspondingly biases the activator 30 toward its unactivated position, and the engagement block 40 toward its disengaged position.

In the embodiment shown, communication between the trigger tooth 38 and the engagement block 40 is achieved by a slot and pin mechanism. Trigger tooth 38 may define a slot 46, and the engagement block 40 may define an opening 48. Opening 48 may be configured to receive a pin 50. The engagement block 40 and trigger tooth 38 may be coupled together by disposing the pin 50 into both the opening 48 and the slot 46. As trigger tooth 38 is moved between its first and second position, slot 46, which may be diagonally oriented, facilitates movement of pin 50. As pin 50 moves along slot 46, movement of the engagement block between its engaged and disengaged position is also achieved. Those skilled in the art will recognize that the slot and pin mechanism can be reversed such that the engagement block 40 defines the slot and the trigger tooth 38 defines the opening.

The vise table 10 may also include a plurality of legs 52. Legs 52 may be movable between a foldable position and a deployed position, wherein in said foldable position, the legs 52 may be folded and stored within the table block 12. In the deployed position, legs 52 provide support for the vise table 10.

The vise table 10 may also include a handle 54. Said handle allows an operator to easily transport the vise table 10.

INDUSTRIAL APPLICABILITY

The vise table 10 described herein allows a user to have a work table and vise in the same apparatus. The disclosed vise table 10 contains a table block 12, a vise head block 16, a threaded guide 18 and an activation mechanism 28. The vise head block 16 is configured to move between an open position and a closed position. In said open position, the vise head block 16 is distal from the table block 12. In the closed position, the vise head block 16 is adjacent the table block 12. The activation mechanism 28 allows an operator to selectively move the vise head block 16 in a threaded mode or an unthreaded mode. As seen in FIG. 3, in said threaded mode, the vise head block 16 may only be moved by rotating the threaded guide 18. Thus, the threaded mode is suitable for fine or tightening movements of the vise head block 16. In the unthreaded mode, as shown in FIG. 2, movement of the vise head block 16 may only be achieved by applying force in the desired direction of movement. Thus, the unthreaded mode is suitable for quick, broad movements of the vise head block 16 that cover a relatively large distance. The selective operation of the vise table 10 in both the threaded mode and unthreaded mode will now be described.

An operator using the disclosed vise table 10, may begin with vise head block 16 in the open position. Upon disposing an object 22 within the space created between the vise head block 16 and the table block 12, an operator may desire to move the vise head block 16 into its closed position so that she can work on said object 22 while the vise table 10 holds it in place. Moreover, for speed and efficiency, an operator may desire to move the vise head block 16 into its closed position quickly. Thus, the time-consuming nature of the threaded mode, (i.e., rotating the threaded guide 18 to move the vise head block 160), may not be preferred. The activation mechanism 28 of the present disclosure allows an operator to move the vise head block 16 in an unthreaded mode, wherein she can quickly slide the vise head block 16 into its closed position. Once in the closed position, the movement of the vice head block 16 may automatically switch from the unthreaded mode to the threaded mode, wherein rotation of the threaded guide will allow the vise head block 16 to further tighten and hold said object 22 in place.

The activation mechanism 28 may be disposed within may include the following components: an activator 30; a trigger tooth 38; and an engagement block 40. The activator 30 is movable between an unactivated position and an activated position. In a preferred embodiment, the activator 30 may be a flap 32 that is hinged to the table block 12. In the unactivated position, the flap 32 may include an edge 36 hinged away from the table block 12. In the activated position, edge 36 may be adjacent to the table block.

The trigger tooth 38 is in communication with the activator 30 and is movable between a first and second position. The movement of the activator 30 controls the movement of the trigger tooth 38. When the activator 30 is in the unactivated position, the trigger tooth 38 is in its first position. When the activator 30 is in the activated position, the trigger tooth is in its second position. In a preferred embodiment, the trigger tooth 38 defines a slot 46.

The engagement block 40 includes a threaded portion 42 that is configured to correspond to the threaded guide 18. When the threaded portion 42 and the threaded guide 18 are engaged to one another, movement of the vise head block 16 can be achieved by rotating the threaded guide 18. The engagement block 42 is in communication with the trigger tooth 38 and is movable between a disengaged position and an engaged position. When the trigger tooth 38 is in the first position, the engagement block 40 is in the disengaged position, wherein the threaded portion 42 is disengaged from the threaded guide 18. When the engagement block 40 is in the disengaged position, movement of the vise head block 16 is in the unthreaded mode. Conversely, when the trigger tooth is in the second position, the engagement block 40 is in the engaged position, wherein the threaded portion 42 is engaged to the threaded guide 18. When the engagement block 40 is in the engaged position, movement of the vise head block 16 is in the threaded mode. In a preferred embodiment, the engagement block 40 may define an opening 48. Pin 50 may be disposed within the opening 48 and into slot 46, thereby coupling the trigger tooth 38 and engagement block 40 into communication with one another.

The activation mechanism 28 may also include a spring 44. Spring 44 may be configured to bias the trigger tooth toward its first position. Consequently, because the trigger tooth is in communication with both the activator 30 and the engagement block 40, when spring 44 biases the trigger tooth into its first position, the activator 30 is biased into its unactivated position, and the engagement block 40 is biased into its disengaged position. Thus, the overall activation mechanism 28 is biased toward the unthreaded mode. (See FIG. 2). Those skilled in the art will recognize that when the threaded mode is desired, the vise head block 16 is moved into its closed position, wherein force is applied to the activator 30 against the bias of spring 44. When this happens, activator 30 is moved into its activated position. This simultaneously moves the trigger tooth 38 into its second position and moves the engagement block 40 into its engaged position. (See FIG. 3).

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A vise table comprising:

a table block including an upper work surface;

a vise head block operably connected to the table block via a threaded guide, and wherein said vise head block is configured to move between an open position and a closed position, wherein in said open position, the vise head block is distal from the table block, and in said closed position, the vise head block is adjacent to the table block;

a rotator configured to selectively rotate the threaded guide in either a first direction or a second direction, wherein rotating the threaded guide in the first direction moves the vise head block toward the open position, and rotating the threaded guide in the second direction moves the vise head block toward the closed position; and an activation mechanism configured to selectively facilitate movement of the vise head block in either a threaded mode or an unthreaded mode, wherein in said threaded mode, movement of the vice head block can only be achieved by rotating the threaded guide, and in said unthreaded mode, wherein movement of the vise head block can only be achieved by applying force to the vise head block in the desired direction of movement, said activation mechanism comprising:

an activator movable between an unactivated position and an activated position;

a trigger tooth in communication with the activator and movable between a first position and second position, wherein movement of the activator controls movement of the trigger tooth, and wherein when activator is in the unactivated position, the trigger tooth is in the first position, and wherein when the activator is in the activated position, the trigger tooth is in the second position; and an engagement block having a threaded portion configured to correspond the threaded guide, and wherein said engagement block is in communication with the trigger tooth and movable between a disengaged position and an engaged position; wherein when the trigger tooth is the first position, the engagement block is in the disengaged position, wherein the threaded portion is disengaged from the threaded guide, this corresponds to the unthreaded mode, and wherein when the trigger tooth is in the second position, the engagement block is in the engaged position, wherein the threaded portion is engaged to the threaded guide, this corresponds to the threaded mode.

2. The vise table of claim 1, wherein the activation mechanism further includes a spring that biases the trigger tooth such that the activator is in the unactivated position.

3. The vise table of claim 1, wherein the activator is an activator flap hinged to the table block; and wherein in the unactivated position, an edge of the flap is hinged away from the table block, and in the activated position, an edge of the flap is adjacent to the table block.

4. The vise table of claim 1, wherein the activator is selected from the group consisting of a button, a piston, a switch, and a slide.

5. The vise table of claim 1, wherein the movement of the engagement block is facilitated by a slot and pin mechanism.

6. The vise table of claim 5, wherein the trigger tooth defines the slot, the engagement block defines an opening, and the pin is disposed within the opening and the slot.

7. The vise table of claim 1, further comprising at least one guide disposed between the vise head block and the table block, wherein said guide configured to stabilize the movement of the vise head block as it moved between the open position and the closed position.

8. The vise table of claim 7, further comprising a plurality of legs movable between a deployed position and a folded position, wherein in said deployed position, the legs provide support for the vise table, and in said folded position, the legs are stored within the table block.

9. The vise table of claim 8, further comprising a handle configure to facilitate carrying of the vise table when the legs are in the folded position.

10. The vise table of claim 1, wherein the rotator is selected from the group consisting of a knob, a crank, a handle and a wheel.

* * * * *